US005444951A

United States Patent [19]

Scott et al.

[11] Patent Number: 5,444,951

[45] Date of Patent: Aug. 29, 1995

[54] BRACKET FOR SUPPORTING FENCE POSTS

[76] Inventors: James R. Scott, Seabird Mobile Home Park, RR 1, Ladysmith, British Columbia, Canada, V0R 2E0; Andrew R. Hrytsak, 5909 Tweedsmuir Crescent, Nanaimo, British Columbia, Canada, V9T 5Y7

[21] Appl. No.: 207,292

[22] Filed: Mar. 7, 1994

[51] Int. Cl.[6] ..... F02D 5/54

[52] U.S. Cl. ..... 52/169.9; 52/169.13; 52/296; 248/219.2; 248/316.2; 256/1

[58] Field of Search ..... 52/169.9, 169.13, 296; 256/1; 404/9; 248/219.2, 316.2, 231.3, 231.9, 519

[56] References Cited

U.S. PATENT DOCUMENTS

| | | | |
|---|---|---|---|
| 1,334,812 | 3/1920 | Snow . | |
| 2,863,535 | 12/1958 | Clapper . | |
| 2,905,445 | 9/1959 | Blum | 248/219.2 X |
| 3,114,528 | 12/1963 | Forest . | |
| 3,381,427 | 5/1968 | Watson | 52/296 |
| 3,721,463 | 3/1973 | Attwood et al. | 248/219.2 X |
| 3,962,774 | 6/1976 | Noro . | |
| 4,074,941 | 2/1978 | Jablonski | 248/219.2 X |
| 4,075,473 | 2/1978 | Winston . | |
| 4,269,534 | 5/1981 | Ryan | 256/1 X |
| 4,546,944 | 10/1985 | Cea | 248/219.2 |
| 5,165,663 | 11/1992 | Wells . | |

OTHER PUBLICATIONS

Vinylgard Installation Guide, Daymond Building Products, (Publication Date Unknown—At least 2 years old.).

*Primary Examiner*—Carl D. Friedman
*Assistant Examiner*—Christopher Todd Kent
*Attorney, Agent, or Firm*—Buchanan Ingersoll; Lynn J. Alstadt

[57] ABSTRACT

A bracket is provided that is rigid and can be attached to a solid surface. The bracket allows a vinyl fence post to be fitted over and locked in place thus avoiding the necessity of pouring concrete into the post to provide a rigid post. The bracket has a base plate with bolts or anchor bolts that connects to a solid surface, an elongated member extends up from the base plate and has a cross-section to provide a sliding fit within a fence post. An expansion mechanism is provided at the top of the longitudinal member with tapered sides extending from within the longitudinal member to a larger cross-section than within the longitudinal member, and a tensioning bolt between the expansion basket and the bracket to force the expansion basket within the longitudinal member and expand the bracket to grip a fence post positioned over the longitudinal member.

8 Claims, 2 Drawing Sheets

BRACKET FOR SUPPORTING FENCE POSTS

TECHNICAL FIELD

The present invention relates to a bracket that can be attached to a concrete base, a wooden base or any solid surface and permits a fence post or a railing post to be fitted over the bracket and attached thereto.

BACKGROUND ART

Many fence posts and railing posts today are made of vinyl. In most cases they need to be rigidly attached to a base and this is generally done by attaching anchor rods to the base, placing the hollow posts over the anchor rods and then pouring concrete into the hollow vinyl post so when the concrete sets, a solid post is supposed to be provided. The arrangement requires fairly accurate lining up of the posts on the anchor rods, however, it is found that the concrete aggregate is generally too large to effectively fill up the space in the vinyl post, and when the concrete sets, shrinkage occurs which allows movement between the concrete and the vinyl post. Thus in many cases, the post is not solid but has some side movement which is not satisfactory.

Throughout the text the words "fence posts" includes railing posts and other kinds of posts that are attached to a base. The fence posts may be used in balconies, stairways and the like and are mounted on a wooden base or a steel base in which case generally anchor bolts or threaded rods are used to attach the post to the balcony. Nuts are attached onto both ends of the anchor rods to grip the wooden or steel beams. Alternatively, long wood screws with extended heads may be used for attaching to wooden beams. The extended heads provide a hold for the concrete in the posts. In the case of a concrete base or a rock base, anchor bolts and anchor rods are used for attaching the posts to the base.

Whereas the posts are disclosed as being made of PVC, aluminum posts or other suitable materials may also be used. By pouring the concrete inside the posts, one provides a solid post not subject to deformation or flexing as are hollow posts. The methods of attachment for railings, etc., to the posts are not indicated here and do not form part of the present invention. However, clearly for both stair rails, balcony railings and the like there are known arrangements of hand railings that are joined to the posts.

DISCLOSURE OF INVENTION

It is an aim of the present application to provide a bracket that can first be easily mounted by means of anchor rods or bolts to a concrete, wooden base or other solid surface. A post which may be a hollow vinyl post is provided to slip over the bracket and an attachment arrangement is provided between the bracket and the post, the attachment occurring from the top of the post so no visible connection can be seen, particularly when a cap is inserted over the top of a post.

The present invention avoids the necessity of having to pour concrete inside the post and thus also provides the ability of being able to remove a post by releasing the attachment arrangement between the bracket and the post from the top of the post. In the case where concrete was poured into a post, it was necessary to cut the post free from its base.

The present invention provides a bracket for supporting a fence post comprising: a base plate having attachment means to a base; a longitudinal member extending up from the base plate and attached thereto having at least one aperture therein, the longitudinal member having a cross-section to provide a sliding fit within a fence post; an expansion basket at the top of the longitudinal member, the basket having tapered sides extending from within the longitudinal member to a larger cross-section than within the longitudinal member, tension means between the expansion basket and the longitudinal member to force the expansion basket within the longitudinal member and expand the longitudinal member to grip a fence post positioned over the longitudinal member.

BRIEF DESCRIPTION OF DRAWINGS

In drawings which illustrate embodiments of the present invention.

BEST MODE OF CARRYING OUT THE INVENTION

Figure 1:
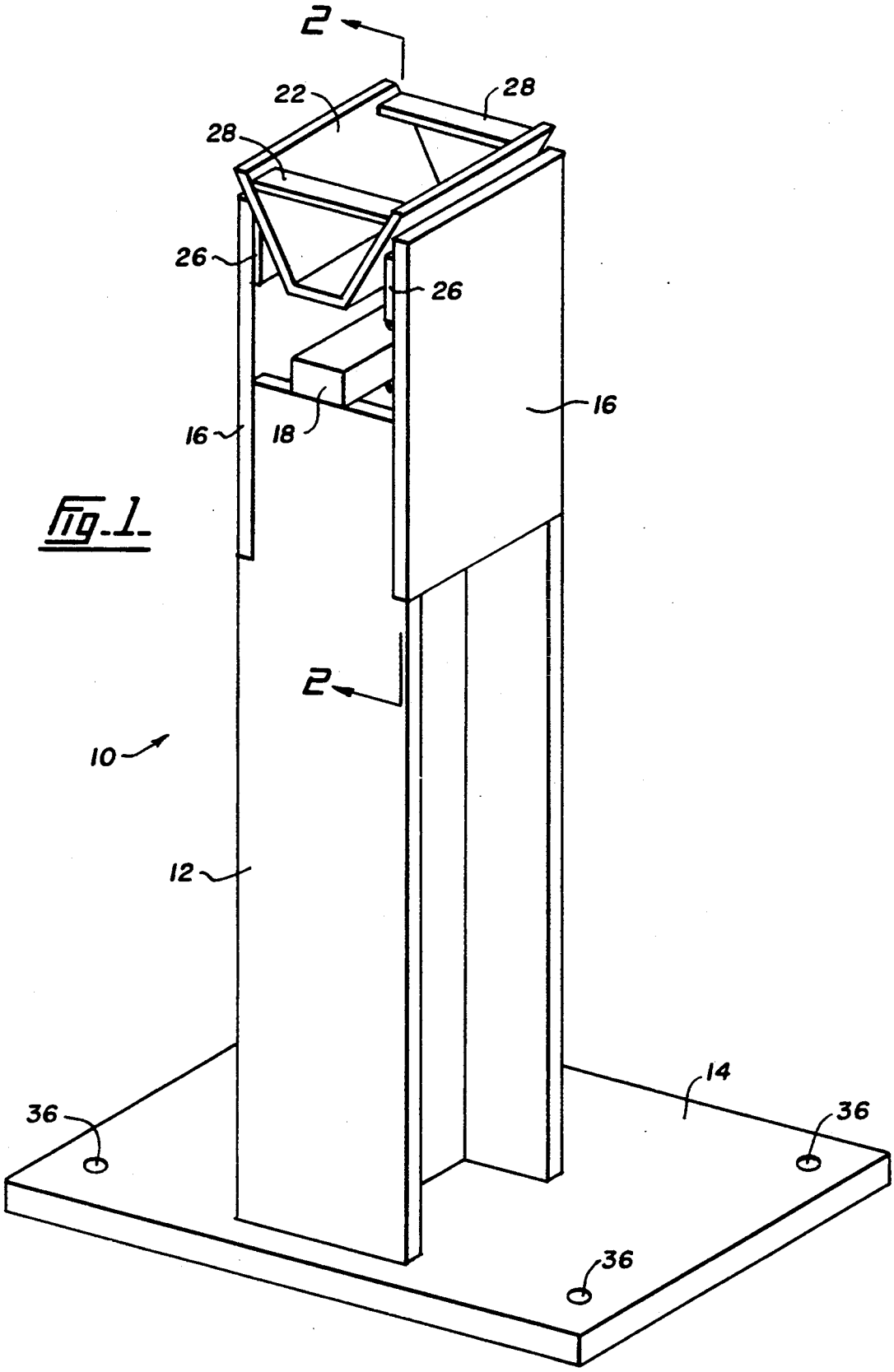
FIG. 1 is an isometric view of a bracket according to one embodiment of the present invention for supporting a fence post.

A bracket 10 is shown in the drawings made from suitable rigid material such as aluminum or steel having sufficient strength to support a vinyl post. The bracket 10 has a wide flange beam 12 welded to a base plate 14. The base plate 14 shown in FIG. 1 is larger than the wide flange beam 12 and thus when a vinyl post fits over the wide flange beam 12, it extends down to the top surface of the base plate 14.

Figure 2:
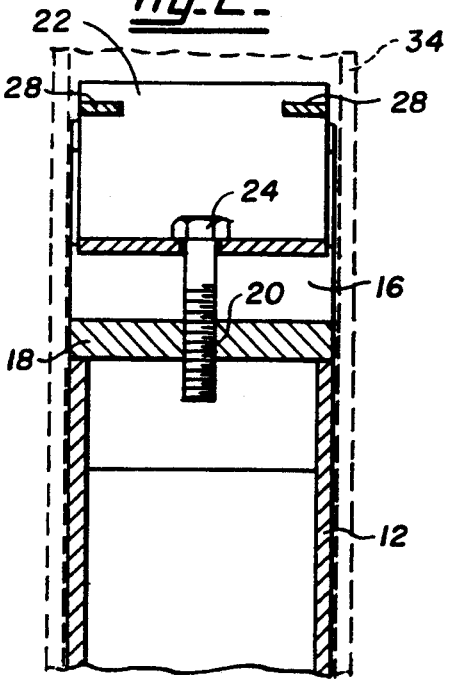
FIG. 2 is a partial cross-sectional view taken at line 2—2 of FIG. 1.

Intermediate plates 16 are welded at the top of the bracket 10 in cutouts on both flanges of the wide flange beam 12 so that the cross-section of the bracket 10 remains the same. A tension bar 18 with a tapped hole 20 in the center thereof is welded on top of the wide flange beam 12, the web of the beam 12 being cut away to avoid interference as shown in FIG. 2. An expansion basket 22, in the form of a U with tapered sides, is positioned on the top of the bracket 10 resting on the top edges of the intermediate plates 16. A tension bolt 24 extends from the middle of the expansion basket 22 fitting into the tapped hole 20. Stiffening plates 26 are positioned on the inside of the intermediate plates 16 just below the top, thus the intermediate plates 16 are reinforced, and the stiffening plates 26 provides two line contact on each side for the sloped sides of the expansion basket 22. The expansion basket 22 has two struts 28 on each side to prevent the sloped sides from deflecting inwards.

The wide flange beam 12 of the bracket 10 is arranged to have a cross-section that is approximately 1/16" less in width than the inside width of a fence post. Thus, the post easily fits over the bracket 10 and then by tightening the tension bolt 24, the expansion basket 22 pushes the intermediate plates 16 apart until they grip the inside walls of the post 34 which is shown in dotted line in FIG. 2.

The base plate 14 as shown in FIG. 1 is much larger than the cross-section of the bracket 10, and thus the post 34 only extends down as far as the top of the base plate 14. Anchor bolts or other types of connections are inserted through holes 36 in the base plate 14, and these bolts may be tightened or loosened regardless of whether or not the vinyl post 34 is in place over the bracket 10.

Figure 3:
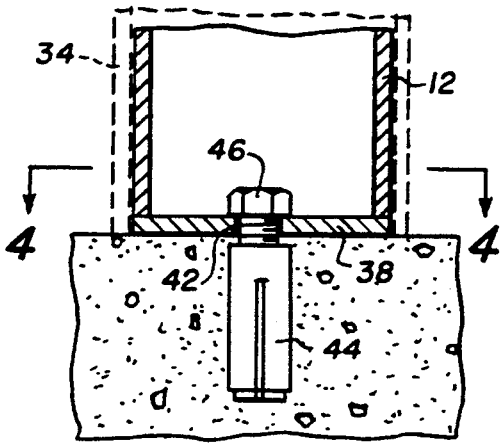
FIG. 3 is a partial cross-sectional view taken at the center line of the bracket of FIG. 1 showing a concrete base.
Figure 3A:
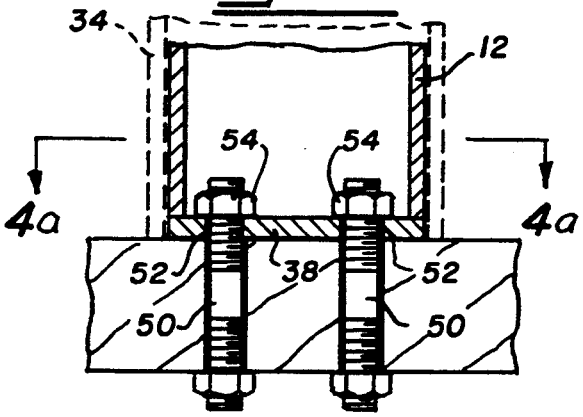
FIG. 3*a* is a partial cross-sectional view taken at the center line of the bracket of FIG. 1 showing a wood beam base.

In FIG. 3 and FIG. *3a,* another type of base plate 38 is shown which is exactly the same cross-section as the wide flange beam 12, thus the vinyl post 34 extends down over the base plate 38 and is not visible when the post 34 is in place.

Figure 4:
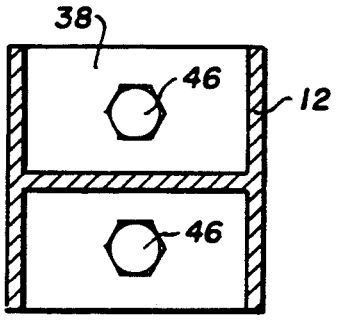
FIG. 4 is a cross-sectional view taken at line 4—4 of FIG. 3.
Figure 4A:
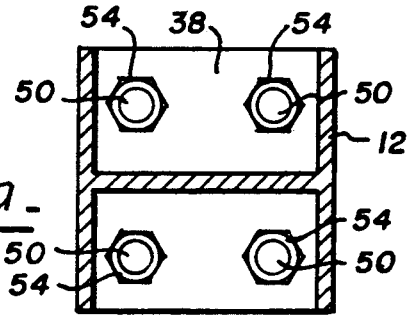
FIG. 4*a* is a cross-sectional view taken at line 4*a*—4*a* of FIG. 3*a*.

The base plate 38 as shown in FIG. 3, is arranged for mounting on a concrete surface. The base plate 38 has two holes 42 therein, one on each side of the web of the wide flange beam 12. When the bracket 38 is to be attached to a concrete base, concrete anchors 44 are placed in the concrete and held by bolt 46 passing through the holes 42 as shown in FIG. 4.

When the base is a wooden beam, four anchor rods 50 are positioned through the four corner holes 52 as shown in FIGS. *3a* and *4a.* Nuts 54 at top and bottom of the anchor rods 54 hold the bracket 10 firmly to the wooden beam.

In the case of a concrete base, the anchors 44 are first positioned in the concrete, the bracket 10 placed over the anchors and the bolts 46 tightened into the anchors by means of a socket wrench that passes through the spaces in the bracket 10 on each side of the web of the wide flange beam 12. In order to tighten the anchors, the expansion basket 22 is removed from the bracket 10. In the case of attaching the bracket 10 to a wooden beam, the anchor rods 50 have the nuts 52 attached thereto and tightened by means of a socket wrench passing through the spaces on either side of the web of the wide flange beam 12.

With the bracket 10 firmly in place and locked to the base, it is now necessary to slide a fence post 34 over the bracket. The post 34 generally extends some considerable distance above the top of the bracket 10, however, a long socket wrench is used to engage the tension bolt 24 and rotate the tension bolt so that the expansion basket 22 is pulled downwards pushing the intermediate plates 16 apart until they engage the insides of the post 34. The post is now firmly held to the bracket 10, and the bracket itself is firmly attached to either a concrete or wooden base. Thus, the post 34 is firmly in position and cannot easily be moved. When the tension bolt 24 has been tightened as far as is necessary for the intermediate plates 16 to grip the insides of the post 34, a cap (not shown) may be placed over the post to prevent water entering the post. There is no need to pour concrete into the post 34 as the bracket 10 has sufficient strength to support a post 34.

The height of the bracket 10 can be varied depending upon the particular requirement. The sizes of the brackets 10 can also be varied to suit different sizes of posts.

Various changes may be made to the embodiments shown herein without departing from the scope of the present invention which is limited only by the following claims.

The embodiments of the invention in which an exclusive property or privilege is claimed are defined as follows:

1. A bracket for supporting a fence post comprising:

a base plate having attachment means to a base;

a longitudinal member extending up from the base plate and attached thereto having at least one aperture therein, the longitudinal member having a cross-section to provide a sliding fit within a fence post;

an expansion basket at the top of the longitudinal member, the basket having tapered sides extending from within the longitudinal member to a larger cross-section than within the longitudinal member, and tension means between the expansion basket and the longitudinal member to force the expansion basket within the longitudinal member and expand the longitudinal member to grip a fence post positioned over the longitudinal member.

2. The bracket according to claim 1 wherein the tension means comprises a bolt in the center of the expansion basket extending down to engage in a tapped hole of a tension bar forming part of the longitudinal member such that tightening the bolt when a fence post is positioned over the longitudinal member engages the fence post to the bracket.

3. The bracket according to claim 1 wherein the base plate is larger than a fence post adapted to be positioned over the longitudinal member, and has holes therein for attachment means in the form of bolts outside the fence post.

4. The bracket according to claim 1 wherein the base plate fits within a fence post adapted to be positioned over the longitudinal member, and has holes therein for attachment means in the form of bolts accessible through the aperture in the longitudinal member.

5. The bracket according to claim 1 wherein the attachment means comprises anchor rods for connection to a wooden beam.

6. The bracket according to claim 1 wherein the attachment means comprises bolts for connection to concrete anchors.

7. The bracket according to claim 1 wherein the base plate, longitudinal and expansion basket are constructed of aluminum.

8. The bracket according to claim 1 wherein the base plate, longitudinal member, and expansion basket are constructed of steel.

* * * * *

UNITED STATES PATENT AND TRADEMARK OFFICE

CERTIFICATE OF CORRECTION

PATENT NO. : 5,444,951

DATED : August 29, 1995

INVENTOR(S) : JAMES R. SCOTT, ANDREW R. HRYTSAK

It is certified that error appears in the above-indentified patent and that said Letters Patent is hereby corrected as shown below:

Column 4, line 52, claim 7, after "longitudinal" insert --member--.

Signed and Sealed this

Fifth Day of December, 1995

*Attest:*

*Attesting Officer*

Bruce Lehman

BRUCE LEHMAN

*Commissioner of Patents and Trademarks*